US006634685B2

(12) United States Patent
Herron et al.

(10) Patent No.: US 6,634,685 B2
(45) Date of Patent: Oct. 21, 2003

(54) ELECTRONICALLY-OPERABLE DOOR STRIKE WITH GUARD CLIP, SPRINGLESS SOLENOID AND FACE PLATE

(75) Inventors: William L. Herron, Frederick, MD (US); Wolfgang Jaffe, Villias, NJ (US); Gary Ferguson, Bedford Hills, NY (US); Carlo Frussinetty, Bronx, NY (US)

(73) Assignee: Trine Access Technology, Inc., Bronx, NY (US)

( * ) Notice: Subject to any disclaimer, the term of this patent is extended or adjusted under 35 U.S.C. 154(b) by 14 days.

(21) Appl. No.: 10/039,472

(22) Filed: Jan. 4, 2002

(65) Prior Publication Data

US 2003/0127869 A1 Jul. 10, 2003

(51) Int. Cl.[7] ..... E05B 15/02
(52) U.S. Cl. ..... 292/341.16; 335/262; 70/277
(58) Field of Search ..... 292/201, 341.16; 70/277, 278.7, 282; 335/262

(56) References Cited

U.S. PATENT DOCUMENTS

| | | | | | |
|---|---|---|---|---|---|
| 381,725 | A | | 4/1888 | Schneider | |
| 393,711 | A | | 11/1888 | Lungen | |
| 3,211,850 | A | | 10/1965 | Toepfer | 200/61.64 |
| 3,378,732 | A | * | 4/1968 | Dietz | 317/123 |
| 3,638,984 | A | | 2/1972 | Davidson | 292/341.16 |
| 3,819,215 | A | | 6/1974 | Fuss | 292/201 |
| 3,861,727 | A | | 1/1975 | Froerup et al. | 292/341.16 |
| 3,944,957 | A | * | 3/1976 | Kotos | 335/174 |
| 4,015,869 | A | | 4/1977 | Horvath | 292/341.16 |
| 4,026,589 | A | | 5/1977 | Hanchett | 292/341.16 |
| 4,056,277 | A | | 11/1977 | Gamus et al. | 292/341.16 |
| 4,153,890 | A | * | 5/1979 | Coors | 335/260 |
| RE30,263 | E | | 4/1980 | Horvath | 292/341.16 |
| 4,211,443 | A | | 7/1980 | Butts et al. | 292/341.16 |
| 4,442,418 | A | * | 4/1984 | Myers | 335/230 |
| 4,815,776 | A | | 3/1989 | Fuss | 292/341.16 |
| 4,838,591 | A | * | 6/1989 | Fuss | 292/341.16 |
| 4,867,496 | A | | 9/1989 | Thomas | 292/341.16 |
| 5,076,625 | A | | 12/1991 | Oxley | 292/341.16 |
| 5,490,699 | A | | 2/1996 | Uyeda | 292/341.16 |
| 5,681,070 | A | | 10/1997 | Williams et al. | 292/341.16 |
| 5,788,295 | A | | 8/1998 | Fuss et al. | 292/341.16 |
| 5,850,753 | A | * | 12/1998 | Varma | 70/278 |
| 5,924,750 | A | * | 7/1999 | Fuss | 292/201 |
| 5,988,711 | A | | 11/1999 | Toma | 292/341.16 |
| 5,994,895 | A | * | 11/1999 | Bolte | 324/207.16 |
| 6,076,870 | A | * | 6/2000 | Frolov | 292/341.16 |

* cited by examiner

*Primary Examiner*—Gary Estremsky
(74) *Attorney, Agent, or Firm*—Norris, McLaughlin & Marcus

(57) ABSTRACT

An electronically-operable door strike employing a guard clip for deterring picking of the locking mechanism therein, a springless solenoid designed to avoid the undesirable build-up of residual magnetism and which incorporates air gaps for dissipating heat, thus prolonging the useful life of the solenoid, and a face plate for mounting the strike into a door jamb.

12 Claims, 12 Drawing Sheets

ELECTRONICALLY-OPERABLE DOOR STRIKE WITH GUARD CLIP, SPRINGLESS SOLENOID AND FACE PLATE

BACKGROUND OF THE INVENTION

1. Field of the Invention

The present invention is directed to door locking devices and, more particularly, to electromagnetically controlled door locks that are actuatable from remote locations throughout a building. Such locks, known generally as "electric strikes", are commonly used to prevent the opening of an associated access obstructing member, such as a door, in hotels, offices, apartment buildings, storage cabinets and appliances. In a preferred embodiment the electric strike of the present invention employs a guard clip for deterring picking of the locking mechanism, a springless solenoid designed to prevent the build-up of residual magnetism which otherwise impairs a solenoid's ability upon activation to release the locking mechanism, and a one piece face plate for mounting in a door jamb which serves to house the electric strike and guide the latch bolt associated with an access obstructing member into engagement with the latch bolt keeper of the electric strike.

2. Description of the Related Art

Electronically-operable door strikes installed in a door jamb to secure a door against opening are known in the art. Electric strikes typically provide a latch bolt keeper mounted on a pivot. The ability of the keeper to rotate on the pivot is electronically controlled. When the keeper is free to rotate to a latch bolt releasing position, the latch bolt associated with the access obstructing member is not retained in the door jamb and the access obstructing member can be opened. When the keeper is not free to rotate, that is, it is in its latch bolt securing position, the latch bolt is retained by the latch bolt keeper, thus securing the door.

Fundamentally, the function of an electric door strike is based on the fact that a retractable stop lever engages the latch bolt keeper and holds it in its latch bolt securing position. That is, the stop lever prevents the latch bolt keeper from rotating. The stop lever is sometimes held in its engaging position with the latch bolt keeper by a lock lever spring-urged into interlocking relationship with the stop lever. To permit the latch bolt keeper to rotate to its latch bolt releasing position, a solenoid is often employed. The solenoid is electronically energized, normally by means of a circuit completing switch remote from the door strike, and the lock lever is moved out of its locking engagement with the stop lever by the action of the solenoid plunger either pulling or pushing the lock lever. The stop lever, no longer being engaged by and being held in position by the lock lever, is incapable of resisting pivoting of the latch bolt keeper when force is applied to the keeper. The keeper is therefore able to be rotated and the door thus able to be opened.

One drawback of some of the electric strikes heretofore available is the ease with which they can be picked open and defeated by the insertion of a tool for unauthorized movement of the latch bolt keeper to a latch bolt releasing position. U.S. Pat. No. 3,638,984 to Davidson and U.S. Pat. No. 3,861,727 to Froerup et al. disclose a latch bolt keeper provided with a lateral edge projection arranged to occupy an overlapping position with respect to an edge of the strike plate and thus close the space between this edge and the adjacent face of the latch bolt keeper so as to provide against the insertion of a picking tool. U.S. Pat. No. 4,026,589 to Hanchett, Jr. also discloses a latch guard which precludes insertion of a tool. Finally, U.S. Pat. No. 4,056,277 to Gamus et al. discloses a plurality of pin-like protrusions positioned to form a barrier to prevent access by a tool to the ball and socket arrangement which serves to hold the latch keeper of that invention in place. Unlike the prior art electric strikes heretofore disclosed, the present invention utilizes a unique guard clip designed to prevent a tool from gaining access to the lock lever and further, by means of its fish hook-like configuration, to redirect any tool which is inserted into the electric strike away from the lock lever and the stop lever.

Another disadvantage of the electric strikes heretofore available is the undesirable build-up of residual magnetism within the solenoid or on the solenoid plunger. It is essential for proper operation of a solenoid that it lose its magnetic force once input electrical power to the solenoid is removed, thus allowing the solenoid plunger to return to its original position. Any magnetic field which remains when electrical power is removed is termed residual magnetism. The residual magnetism present in prior art electric strikes is occasioned by the frequent contact between two ferrous metal surfaces such as a ferrous metal solenoid plunger striking a ferrous metal lock lever during repeated energization and de-energization of the solenoid. Build-up of residual magnetism during repeated cycling of the solenoid results in the eventual failure of the solenoid's ability to remotely disengage the lock lever and the stop lever so as to permit the latch bolt keeper to be rotated and the access obstructing member opened. In some electric strikes termed "fail-safe" or "power to lock" by those of skill in the art, the plunger is pulled into the solenoid body when energized. This action of the plunger pulls the spring-resistive lock lever into engagement with the stop lever, thus preventing the latch bolt keeper from pivoting from its latch bolt securing position to its lockset latch bolt releasing position. When the solenoid is de-energized, the spring-urged lock lever returns to its original position where it is disengaged from the stop lever, thus allowing the latch bolt keeper to be pivoted to its lockset latch bolt releasing position. Upon the build-up of residual magnetism along the plunger or solenoid body, however, the plunger can remain in contact with the lock lever or not fully exit the body of the solenoid, thus compromising the ability of the lock lever to disengage from the stop lever. In the operation of other electric strikes, termed "fail-secure" by those of skill in the art, the plunger is pulled from its starting position into the body of the solenoid upon energization and this action releases the stop lever, thus permitting the latch bolt keeper to rotate. Upon de-energization the plunger exits the solenoid body by means of a spring and is returned to its starting position. Again, however, upon the build-up of residual magnetism along the plunger, the plunger may not be able to be completely returned to its starting position by the spring mechanism, thus compromising the solenoid's ability to return the stop lever or lock lever to a position where the latch bolt keeper is prevented from rotating.

Yet an additional drawback of prior art electric strikes is the large amount of cutting into a door jamb which is necessary to install the strike and its associated face plate. The ANSI standard face plate measures 4⅞ inches in length by 1¼ inches in width. Typically, electric strike face plates also utilize an auxiliary ramp which measure 3⅜ inches in length, thus necessitating that a corresponding length of the door jamb be removed at a depth of about one-half inch or more to properly seat the face plate and auxiliary ramp into the jamb. This large amount of cutting requires more time and money to install than otherwise would be necessary with an electric strike and face plate arrangement that reduces the amount of door jamb cutting required for installation. A still further drawback of prior art electric strike face plates occurs in those installations where the electric strike is required to be installed in door jambs which measure 4 inches or wider and the door is to be center hung. In those instances the auxiliary ramp and face plate comprise two or more pieces, thus again requiring more time for installation than if a one-piece face plate and auxiliary ramp were provided.

SUMMARY OF THE INVENTION

For the foregoing reasons, there is a need for an electric strike which overcomes the hereto before described problem of residual magnetism associated with a frequently cycled or continuous duty solenoid plunger. There is a further need for an electric strike in which a tool cannot be used to pry away the lock lever from the stop lever permitting the latch bolt keeper to be rotated and the access obstructing member opened by a tampering intruder. There is yet a still further need for an electric strike and face plate which reduces the amount of door jamb cutting necessary for its installation.

It is thus an object of the present invention to provide an electronically-operable door strike which utilizes a solenoid which avoids the build-up of residual magnetism along the solenoid body or plunger which otherwise would render the electric strike inoperable.

It is a further object of the present invention to provide an electronically-operable door strike which embodies an improved guard to the insertion of a picking tool and which redirects a picking tool away from contacting the lock lever or the stop lever.

It is a still further object of the present invention to provide an electronically-operable door strike and one piece face plate with full lip and auxiliary ramp arrangement which reduces the amount of door jamb material which must be removed for installation of the face plate.

In accordance with the foregoing objects, an electronically-operable door strike which employs a guard clip for deterring picking of the locking mechanism, a springless solenoid designed to avoid the build-up of residual magnetism and a face plate which reduces the amount of door jamb cutting required for installation of the electric strike and face plate arrangement is disclosed. Briefly stated, the invention is practiced by utilizing a guard clip which protects the lock lever and the stop lever from tampering by a tool inserted into the door strike along an edge of the latch bolt keeper and which by virtue of its "fish hook" configuration redirects the tool away from the lock lever. In addition, to avoid the build-up of residual magnetism, a solenoid comprising a ferrous metal shell and front cap, a rear cap of non-ferrous material such as non-ferrous metal, and a ferrous metal plunger with a non-ferrous metal protuberance is provided. An air gap is maintained between the front cap and the plunger body during movement of the plunger to avoid the build-up of residual magnetism between the front cap and the plunger body. An additional air gap is provided between the plunger and a spool within which the plunger moves and around which a wire coil is wrapped inside of the solenoid shell. This additional air gap aids in the dissipation of heat generated when the wire coil of the solenoid is electronically-activated and the plunger is repeatedly cycled. Finally, the face plate associated with the electric strike is designed with a full lip and flange tongue arrangement which reduces the amount of the door jamb which must be removed for the installation of the electric strike and face plate in comparison with heretofore known electric strike and face plate arrangements.

Further objects, features, aspects and advantages will be readily apparent to those skilled in the art and a better understanding of the present invention may be had by reference to the following detailed description taken in connection with the following drawings.

DETAILED DESCRIPTION OF THE INVENTION

Figure 1:
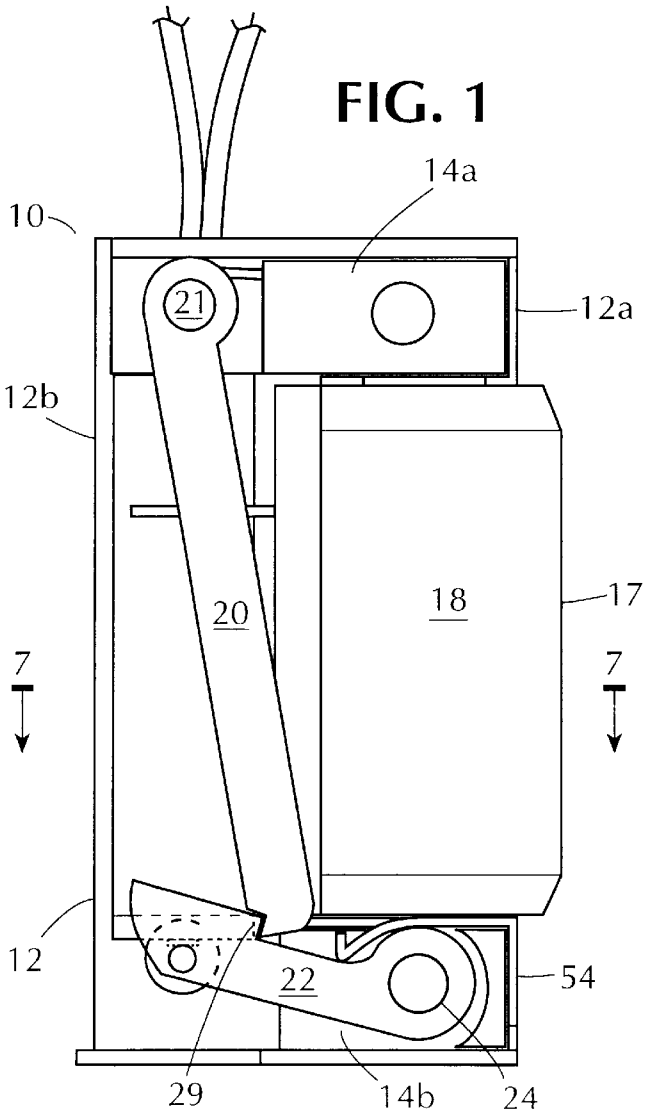
FIG. 1 is a front plan view of the electric strike of the present invention with the cover removed and showing the lock lever in its position engaged with and immobilizing the stop lever such that the latch bolt keeper is maintained in its latch bolt securing position.
Figure 2:
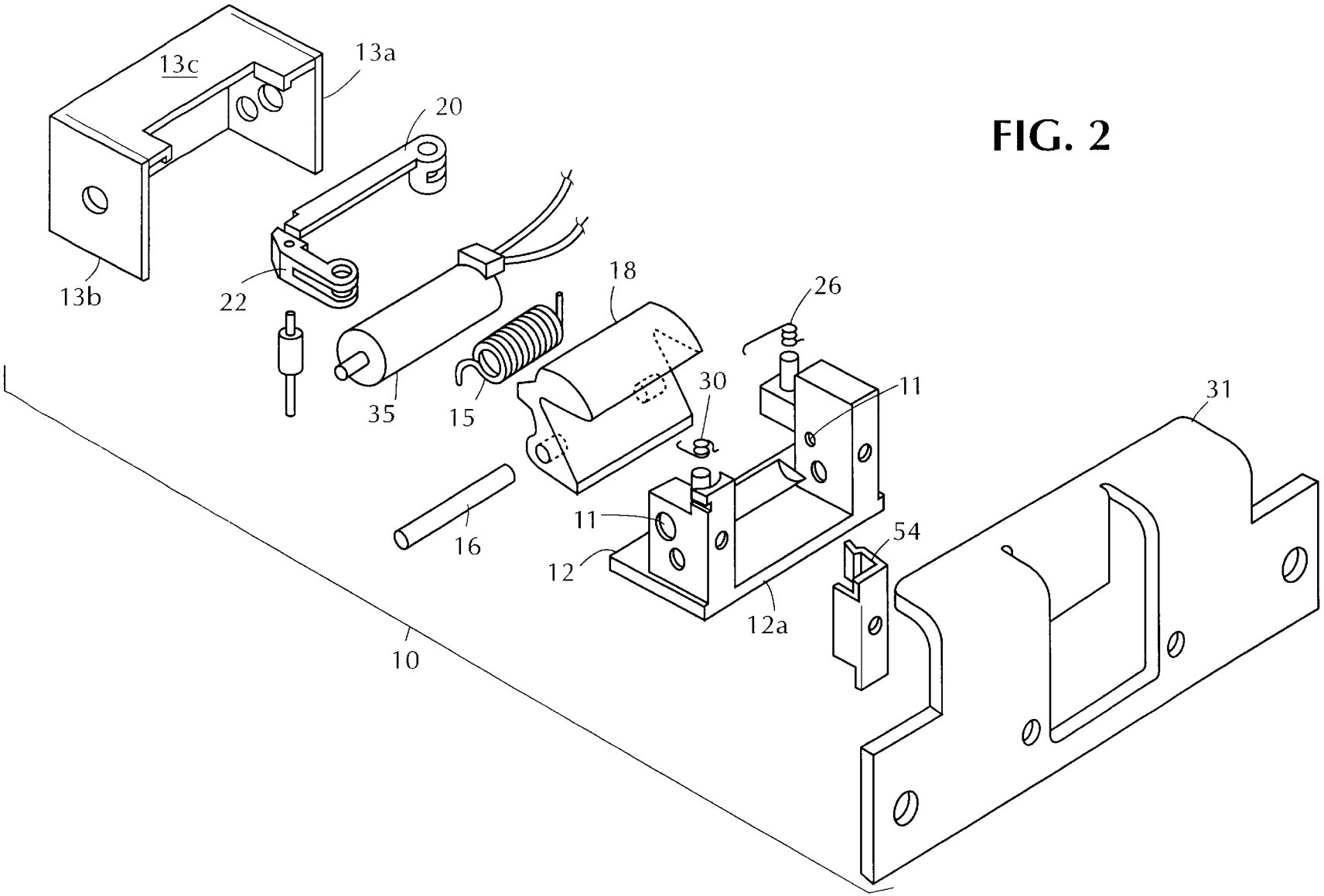
FIG. 2 is an exploded perspective view of the electric strike of the present invention.

Referring now to the drawings there is shown in FIG. 1 an electrically-operable door strike as generally indicated by the numeral 10. The electric strike is comprised of a base 12 having a front edge 12*a* and a rear edge 12*b*. To base 12 are fixedly secured a pair of spaced-apart support blocks 14*a* and 14*b* each provided with threaded openings 11 (see FIG. 2) for receiving screws to fixedly hold a pair of end panels 13*a* and 13*b* and a cover 13*c*. Support blocks 14*a* and 14*b* also carry a shaft pin 16 (see FIG. 2) for rotatably supporting a latch bolt keeper 18. The cross-sectional configuration of the latch bolt keeper may best be observed in FIG. 7. Mounted circumferentially around shaft pin 16 is a cylindrical turning spring 15 which urges the latch bolt keeper 18 into its latch bolt securing position wherein the front edge portion 17 of latch bolt keeper 18 protrudes beyond front edge 12*a* of base 12 (as best seen in FIG. 1), through face plate 31 (FIG. 2) and engages the latch bolt of an adjacent door (not shown).

Figure 3:
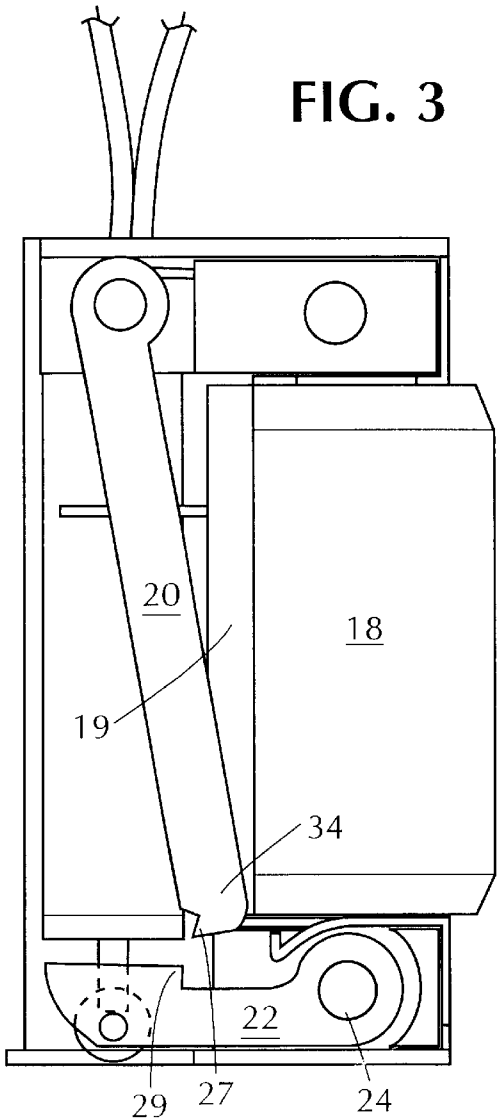
FIG. 3 is a front plan view similar to FIG. 1 showing the solenoid plunger striking the lock lever and the lock lever moved to its position allowing the stop lever to be pivoted and the latch bolt keeper rotated to its latch bolt releasing position.
Figure 5:
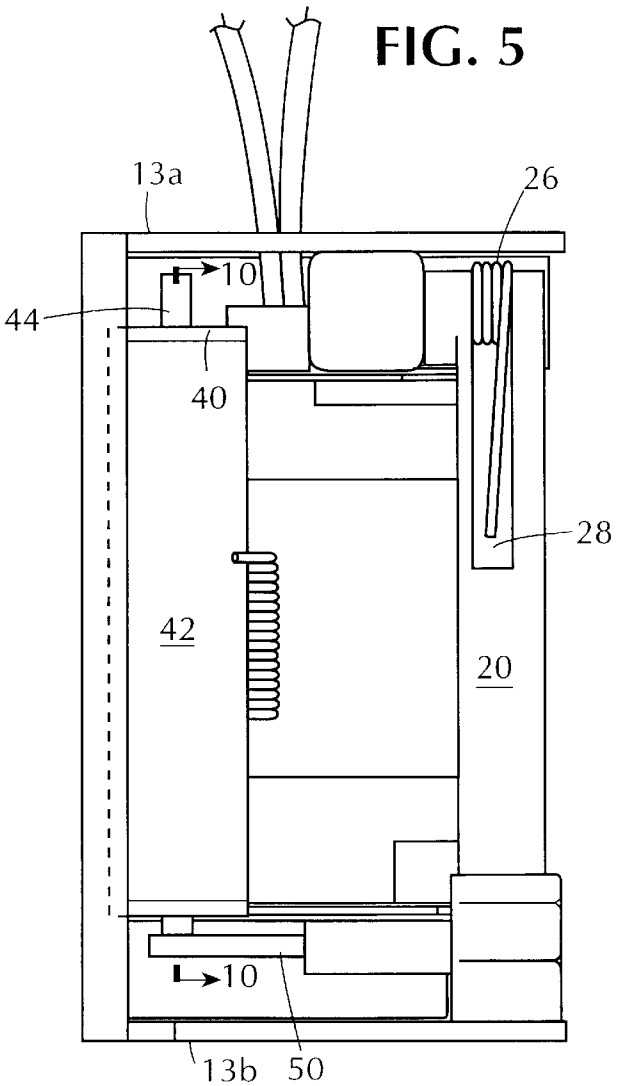
FIG. 5 is a side view of the electric strike of the present invention with the cover removed and showing the solenoid in its non-activated position and the lock lever in its engaged position with the stop lever.
Figure 4:
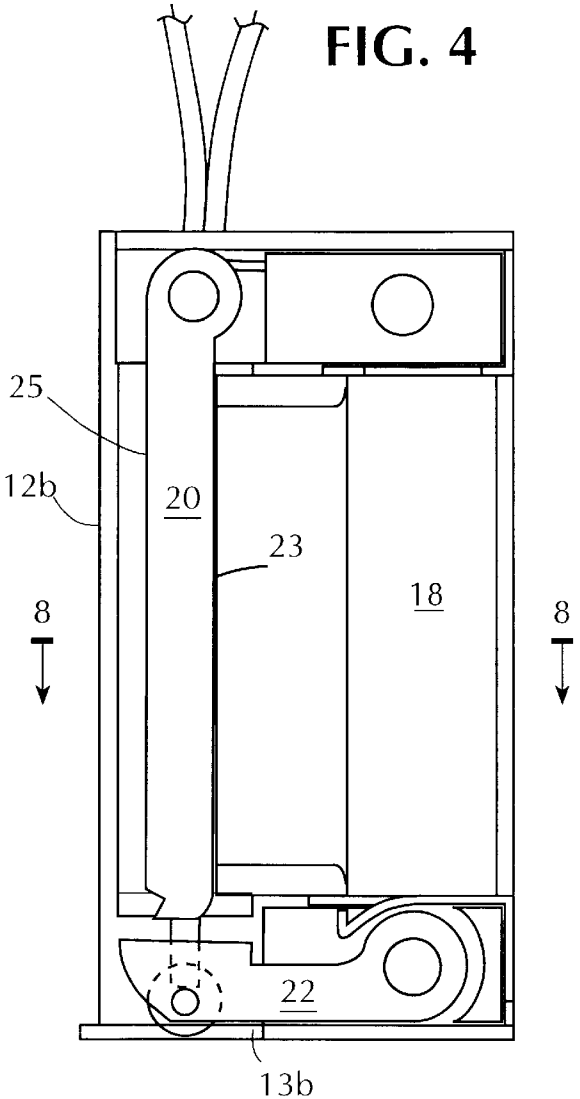
FIG. 4 is a front plan view similar to FIG. 3 showing the latch bolt keeper rotated to its latch bolt releasing position.
Figure 6:
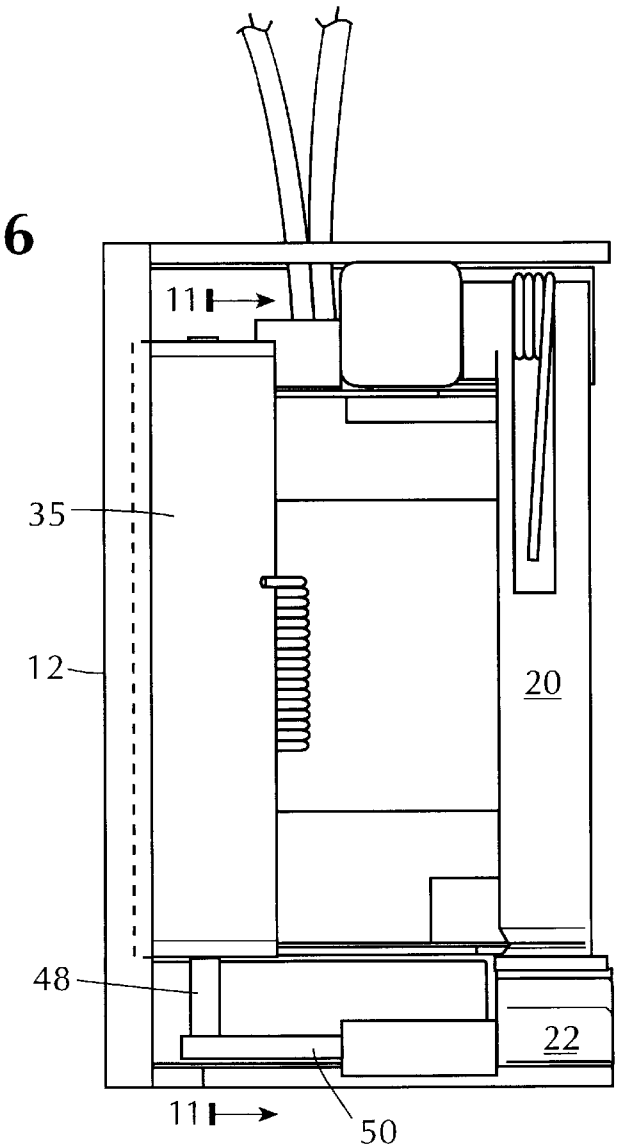
FIG. 6 is a side view similar to FIG. 5 but showing the solenoid in its activated position and the lock lever in its disengaged position with the stop lever.

Referring to FIG. 1, the stop lever 20, which extends substantially along the entire length of base 12, is pivotally secured at one end by means of a pivot pin 21 extending normal to base 12. The free end of stop lever 20 contains shoulder 34 (see FIG. 3) from which tooth 27 protrudes for engagement with angled notch 29 located on the free end of lock lever 22. The shape of tooth 27 can be angular, curved or have a hook-like appearance. The shape of the angled notch 29 similarly can be angular, curved, or have a hook-like appearance. Lock lever 22 is itself pivotally secured at its opposite end by means of pivot pin 24 extending normal to base 12. The stop lever 20 is urged into its locking position whereby it prevents latch bolt keeper 18 from pivoting around shaft pin 16 by means of a torsion spring 26 (see FIG. 5) which, with one leg, engages the wall of support block 14*a* (see FIG. 1) and with its other leg fits into depression 28 of stop lever 20. The lock lever 22 is urged into its interlocking position with the stop lever by means of a torsion spring 30 (see FIG. 2) which engages either both lock lever 22 and pivot pin 24 or both lock lever 22 and support block 14*b*. In this interlocking position, tooth 27 of shoulder 34 of stop lever 20 hooks into angled notch 29 on the free end of the lock lever 22. When lock lever 22 is moved from its locking position shown in FIG. 1 into its releasing position shown in FIG. 3 against torsion spring 30 by action of plunger 44 (see FIG. 12) in a manner to be described, it permits retraction of the stop lever 20. Stop lever 20, however, is initially maintained in its position in which it contacts latch bolt keeper 18 by torsion spring 26. Due to the pivotal motion of the latch bolt keeper 18 by the latch bolt during the opening of the door, the rear edge portion 19 of the latch bolt keeper 18 pushes the stop lever 20 which then pivots and retracts into its open, latch bolt releasing position shown in FIG. 4. After the latch bolt has been released by the latch bolt keeper 18 and the door has been opened, the cylindrical turning spring 15 returns the latch bolt keeper 18 into the latch bolt securing position shown in FIG. 1. In this position, under the action of torsion spring 26, the stop lever 20 snaps with its shoulder 34 behind the free end of the lock lever 22 which is returned to its locking position by spring 30, thus maintaining the latch bolt keeper 18 in its latch bolt securing position.

When tooth 27 and notch 29 are engaged in an interlocking relationship, pressure exerted on latch bolt keeper 18 in an attempt to rotate latch bolt keeper 18 about shaft pin 16 to its latch bolt releasing position serves to more firmly engage tooth 27 and notch 29 and hence stop lever 20 and lock lever 22, thus increasing the locking force or holding integrity of those two levers as they hold the latch bolt keeper 18 in its latch bolt securing position. If both tooth 27 and notch 29 are angled at 90 degrees so that they perpendicularly intersect each other, vibrations applied to the electric strike 10 through the door or door jamb can cause stop lever 20 to vibrate and walk out of its contact with lock lever 22, thus allowing latch bolt keeper 18 to be rotated to its latch bolt releasing position. Therefore, both tooth 27 and notch 29 are preferably angled at less than 90 degrees. With the arrangement of tooth 27 and notch 29 heretofore described, it is observed that a load or force applied to latch bolt keeper 18 in an attempt to rotate latch bolt keeper 18 into its latch bolt releasing position will not disengage stop lever 20 from lock lever 22; however, the slightest amount of force applied directly to lock lever 22 pivots lock lever 22 on pivot pin 24 resulting in the disengagement of the stop lever 20 from the lock lever 22.

Figure 7:
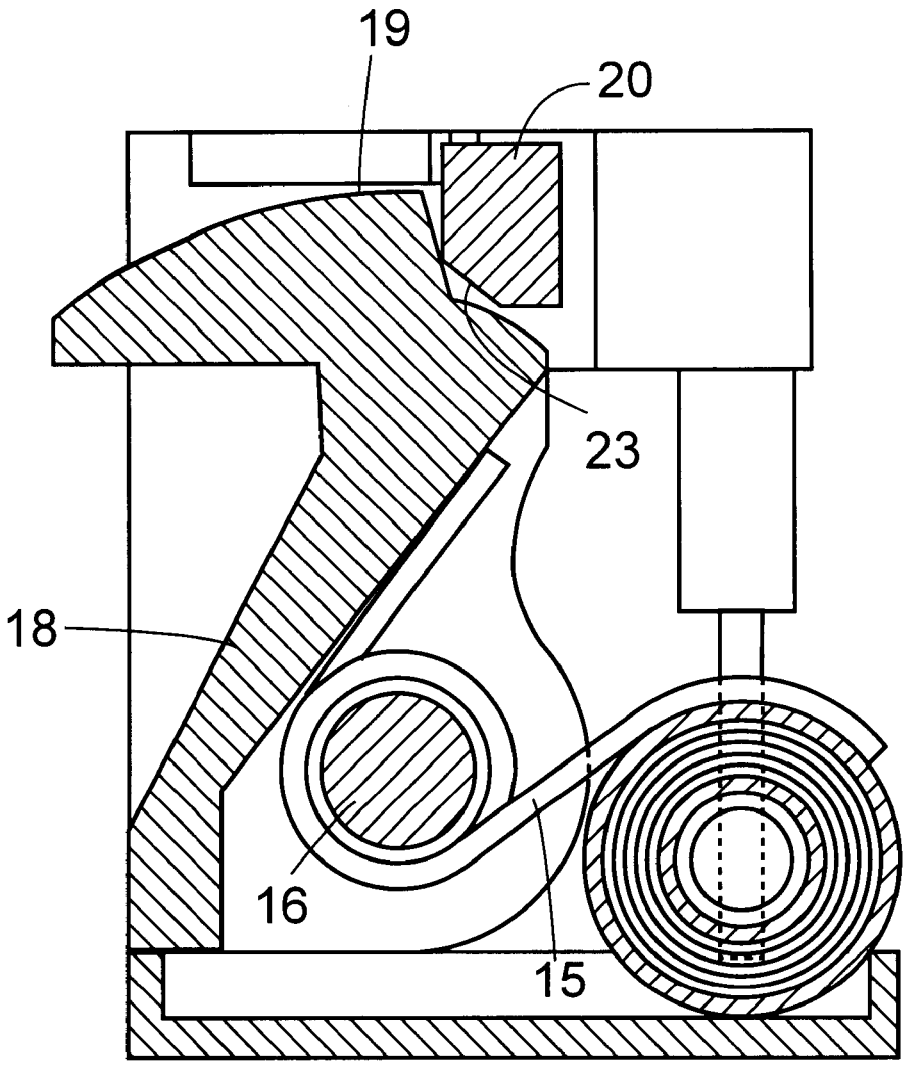
FIG. 7 is a cross-sectional view along line 7—7 of FIG. 1.
Figure 8:
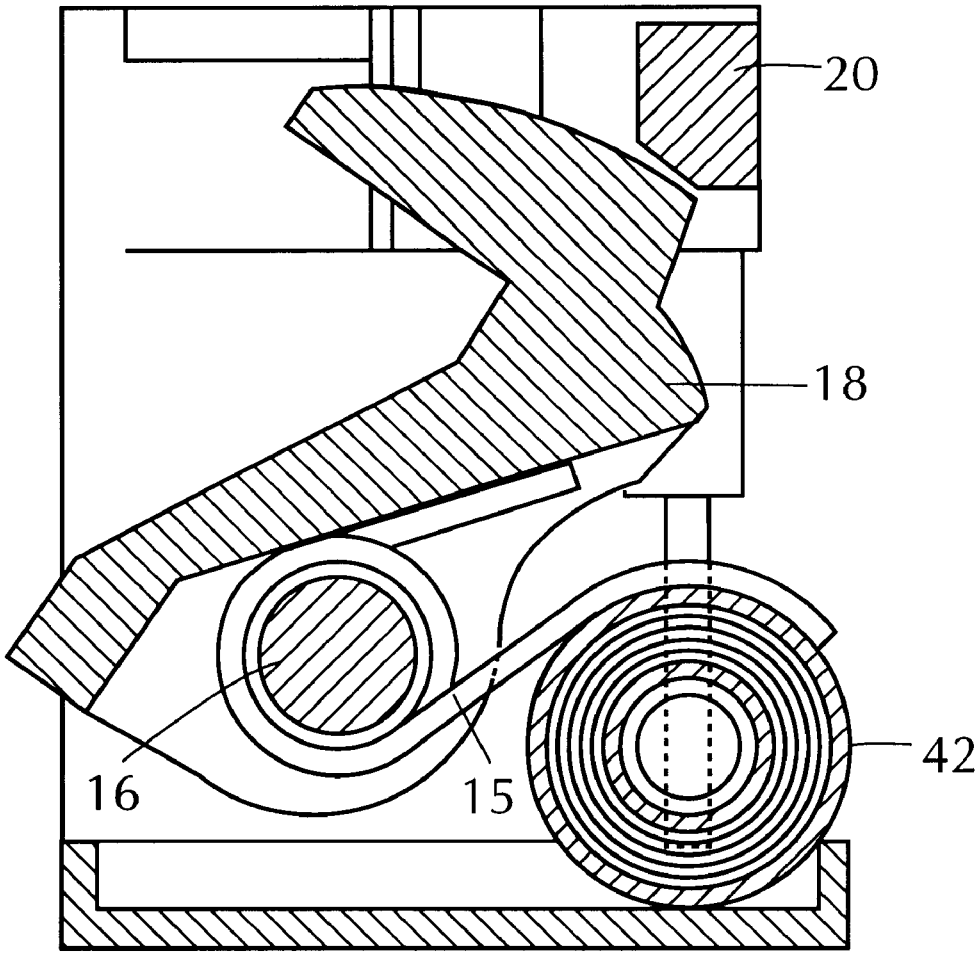
FIG. 8 is a cross-sectional view along line 8—8 of FIG. 4 showing the relationship between the stop lever and the rotated latch keeper.

Rear edge portion 19 of latch bolt keeper 18 is beveled at an angle of approximately 35 degrees as best illustrated in FIG. 7. Front edge portion 23 of stop lever 20 is also beveled at an angle of about 35 degrees. Thus when latch bolt keeper 18 is pivoted about shaft pin 16 (as shown on FIG. 8), rear edge portion 19 of the keeper contacts the front edge portion 23 of stop lever 20 and rotates stop lever 20 on pivot pin 22. Rear edge portion 19 of keeper 18 is permitted to slid behind stop lever 20 by virtue of beveled front edge portion 23 of stop lever 20 and beveled rear edge portion 19 of latch bolt keeper 18. The pivoting motion of latch bolt keeper 18 to its latch bolt releasing position is stopped by shell 42 (see FIG. 5) of solenoid 35. In this manner neither the rear edge portion 25 of stop lever 20 (see FIG. 4) nor the beveled rear edge portion 19 of latch bolt keeper 18 extends beyond rear edge 12*b* of base 12 when latch bolt keeper 18 is pivoted to its latch bolt releasing position. The effect is that the electric strike of the present invention is compact and small in dimension and can be used particularly in those applications where space in the door jamb is limited. Further with respect to size, electric strike 10 has a back set (the depth an electric strike requires to fit into a doorframe) of only about one (1) inch. This feature is important as it allows electric strike 10 to fit into more applications such as doorframes, storage cabinets and appliances with less restrictions due to size.

Figure 9:
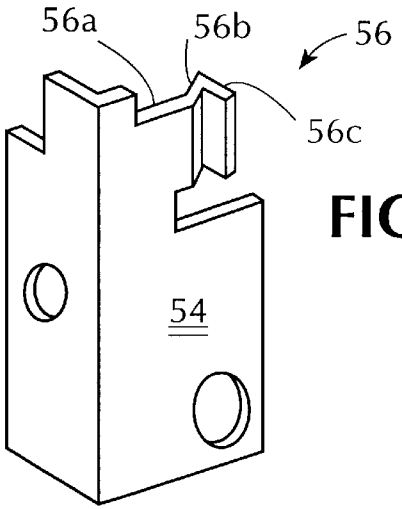
FIG. 9 is a perspective view of the guard clip.

As best illustrated in FIGS. 1 and 9, guard clip 54 is a separate element, not an integral part of base 12, which is disposed between support block 14*b* and latch bolt keeper 18 to minimize the ability of a potential intruder to insert a tool into electric strike 10 along latch bolt keeper 18 for purposes of contacting lock lever 22 and disengaging it from stop lever 20. In those instances where a tool is successfully inserted into electric strike 10, guard clip 54 is also intended to preclude access by the tool to lock lever 22 which, otherwise, could be contacted by the tool and disengaged from stop lever 20. Arm 56 of guard clip 54 is comprised of three portions. First portion 56*a* is of sufficient length to extend perpendicularly from front edge 12*a* of base 12 to at least pivot pin 24 of lock lever 22. Second portion or tab 56*b* of arm 56 is angled away from latch bolt keeper 18 toward lock lever 22 until third portion or flange 56*c* of arm 56 is again angled toward shoulder 34 of stop lever 20. Because of the shape and dimensions of arm 56 of guard clip 54, arm 56 prevents access to lock lever 22 by a tool inserted into electric strike 10 between guard clip 54 and latch bolt keeper 18. Furthermore, any tool, such as an unfurled paperclip or wire, which is inserted into electric strike 10 in this manner will be directed away from lock lever 22 by means of the "fish hook" configuration of arm 56. A guard clip which is not angled in the manner heretofore described will not redirect an inserted tool away from lock lever 22.

Figure 12:
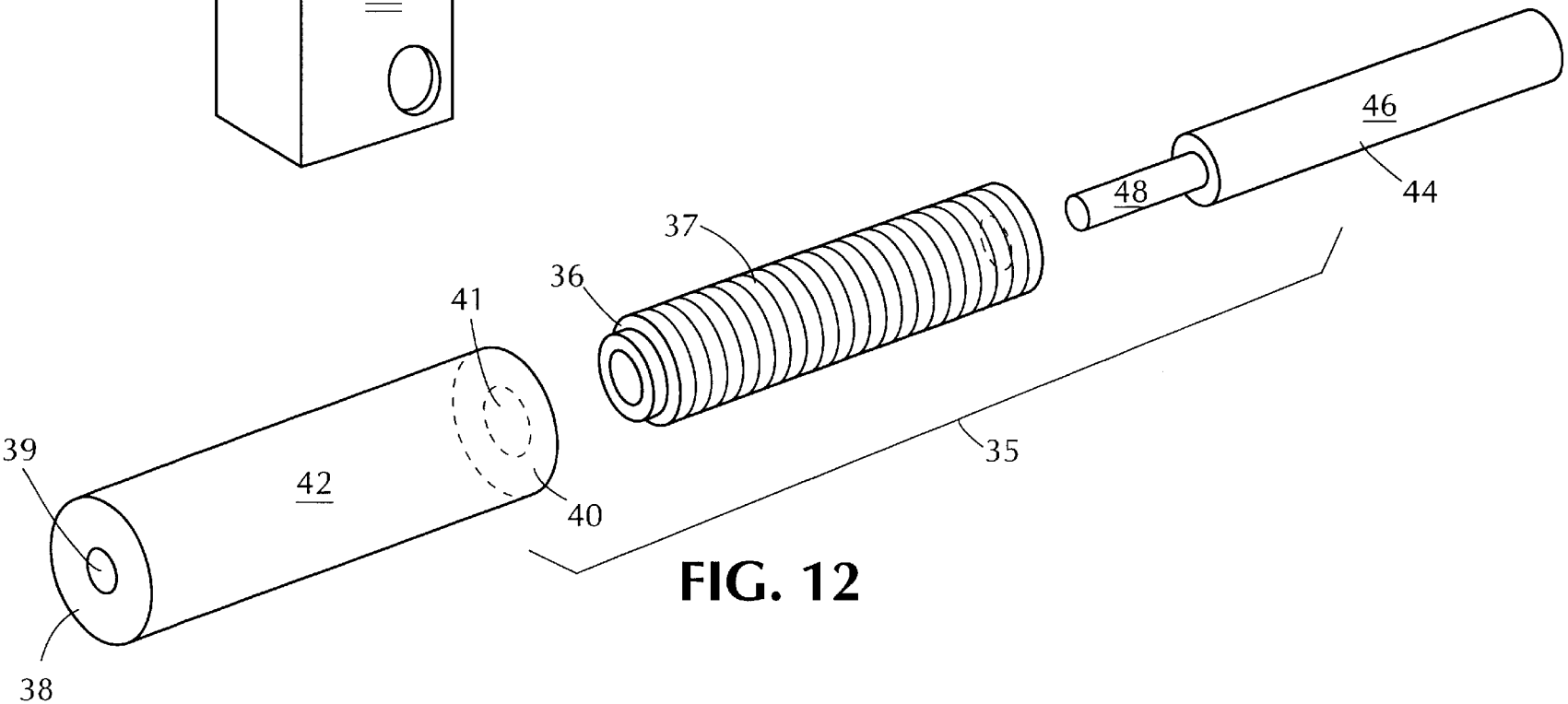
FIG. 12 is an exploded perspective view of the solenoid.
Figure 10:
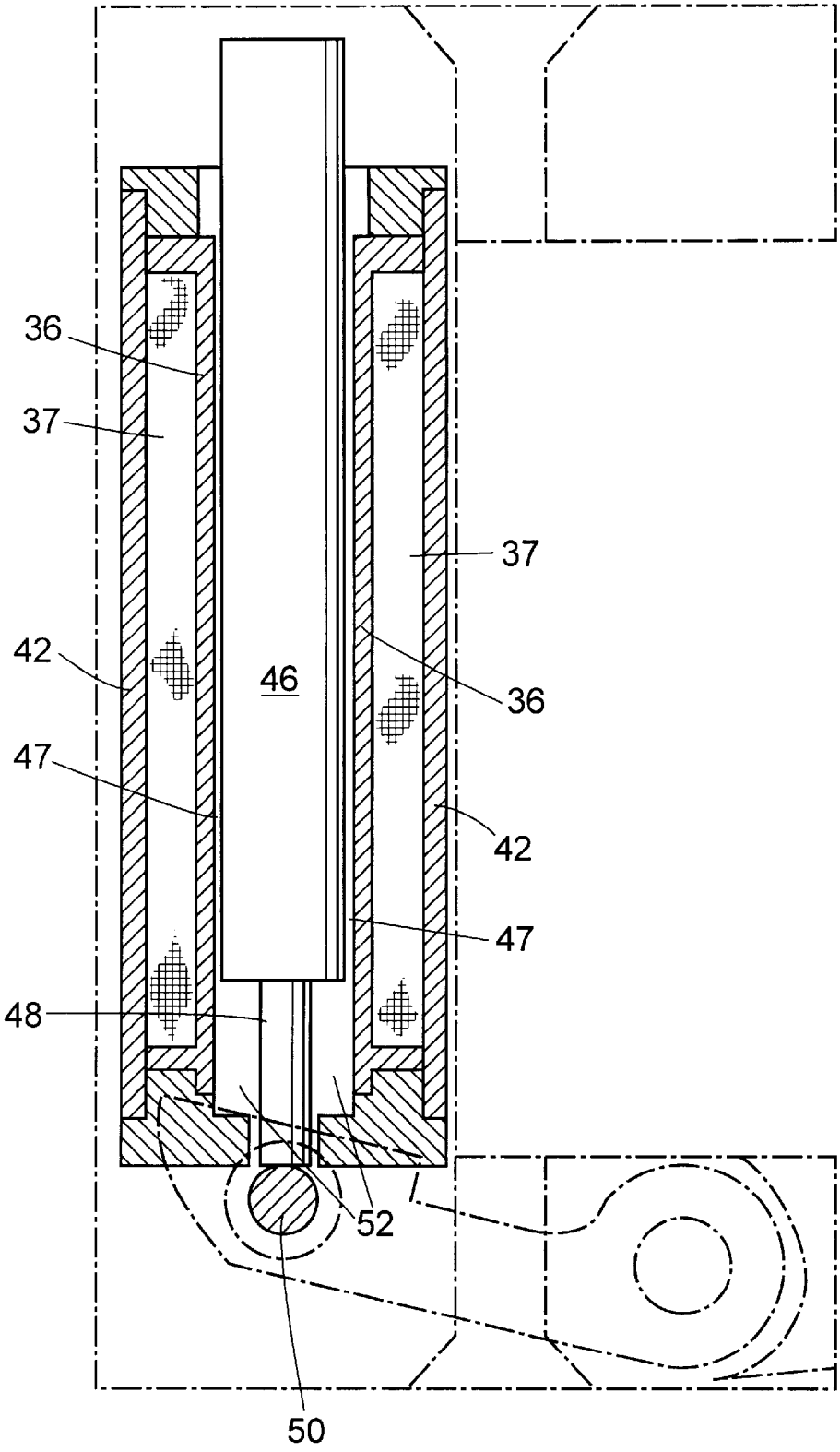
FIG. 10 is a cross-sectional view of the solenoid along line 10—10 of FIG. 5 when the latch bolt keeper is in its latch bolt securing position.
Figure 11:
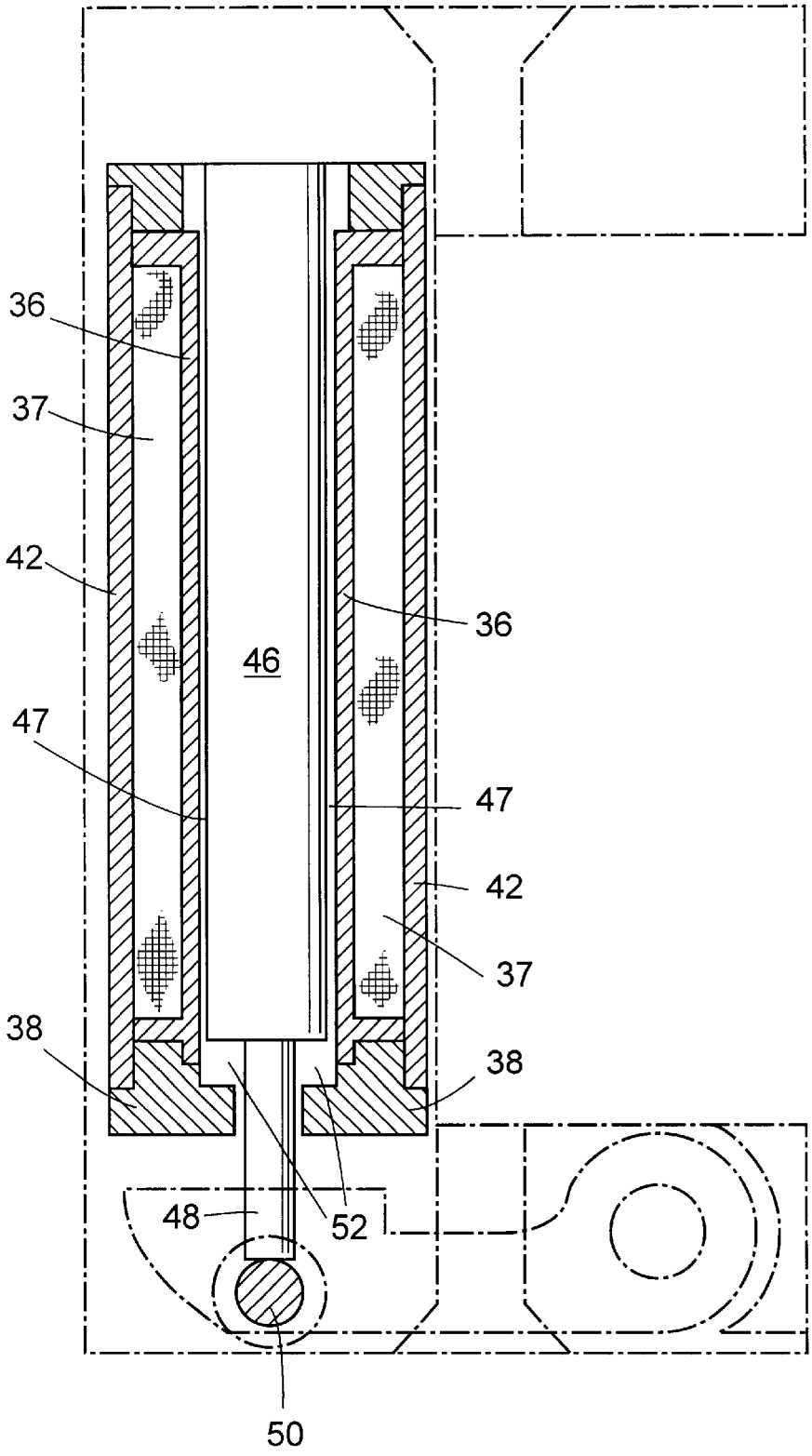
FIG. 11 is a cross-sectional view of the solenoid along line 11—11 of FIG. 6 when the solenoid is energized and the latch bolt keeper is in its latch bolt releasing position.

For moving the lock lever 22 against the force of torsion spring 30 there serves a springless solenoid 35 having an axis that extends in the longitudinal direction of base 12. The solenoid 35, which takes up a substantial portion of the length of the base 12, comprises wire coil 37 wound on a spool 36 made of a thermoplastic polyester resin, such as polyethylene terephthalate polyester resin, high temperature plastic, or other synthetic material. With the solenoid 35 there is associated a front cap 38, a rear cap 40, a cylindrical shell 42 and a plunger 44 which is movable within the spool 36. Plunger 44 is comprised of a plunger body 46 and a protuberance or plunger tip 48 as best seen in FIGS. 10–12. Plunger body 46 is cylindrical in shape and constructed of 1018 soft steel or other ferrous metal. Plunger tip 48 is also cylindrical in shape having a smaller diameter than that of plunger body 46. Plunger tip 48 is constructed of stainless steel or other non-ferrous metal. This choice of materials for plunger tip 48 aids in avoiding the build-up of residual magnetism between front cap 38 and the plunger tip 48 through repeated travel of the plunger tip through the front cap 38, as will be described, in response to repeated cycling of energizing and de-energizing the solenoid 35. Front cap 38 has a hole 39 centrally disposed therein through which plunger tip 48 is movable when solenoid 35 is energized. Front cap 38 is constructed of 1018 soft steel or other ferrous metal which acts as a magnet to pull plunger 44 toward it when solenoid 35 is energized. To direct plunger 44 toward front cap 38 when solenoid 35 is energized, rear cap 40 also has a hole 41 centrally disposed therein through which plunger body 46 is moveable when solenoid 35 is energized. Rear cap 40 is constructed of aluminum, stainless steel, other non-ferrous metal, or other non-ferrous material which will not become magnetized when solenoid 35 is energized. Shell 42 is constructed of steel or other ferrous metal. The shell 42 functions not only as an enclosure for wire coil 37, spool 36 and plunger 44 but also as a stop for latch bolt keeper 18 when it is pivoted about shaft pin 16 into its latch bolt releasing position. Plunger body 46 and plunger tip 48 are supported during the travel of plunger 44 by holes 39 and 41 in front cap 38 and rear cap 40, respectively. Plunger body 46 and plunger tip 48 do not contact spool 36. Thus, a first air gap 47 (see FIGS. 10 and 11) is created between the outer surface of plunger 44 and the inner surface of spool 36. First air gap 47 helps to avoid the build-up of residual magnetism along plunger 44 and further aids in dissipating the build-up of heat in solenoid 35 when the solenoid is energized. This has several advantages. First, air gap 47 helps to avoid expansion of spool 36, and a resulting shrinkage of the inside diameter of spool 36, which otherwise would cause friction or binding between plunger 44 and spool 36 during travel of the plunger towards front cap 38 when solenoid 35 is energized. Second, solenoid 35 is able to be operated at a lower voltage than if no air gap were present because heat does not build-up inside of solenoid 35. Heat build-up would otherwise increase the resistance of wire coil 37 thus requiring more voltage to operate solenoid 35.

When solenoid 35 is energized, plunger body 46 is, by the resulting magnetic attracting forces, moved toward front cap 38 (see FIG. 11). During its motion caused by magnetic attraction, the plunger tip 48 exits the front cap 38 through hole 39 and strikes an aluminum or other non-ferrous metal actuator pin 50 which extends laterally from the underside of the lock lever 22 and which is disposed in the path of travel of the plunger tip 48. As a result of the collision between the plunger tip 48 and the actuator pin 50, the lock lever 22 is pivotally moved about pivot pin 24 into its releasing position against the force of spring 30. The pivotal motion of lock lever 22 and its underlying actuator pin 50 is stopped by end panel 13*b*. As a result, a second air gap 52 is maintained between plunger body 46 and front cap 38, as best illustrated in FIG. 11. This second air gap 52 further resists the build-up of residual magnetism between plunger 44 and front cap 38 which might otherwise result from the repeated striking of plunger 44 against front cap 38 during repeated energization/de-energization cycling of the solenoid. The pivotal motion of lock lever 22 into its releasing position in turn releases stop lever 20 from its engagement with lock lever 22, thereby permitting stop lever 20 to pivot away from latch bolt keeper 18 thus allowing latch bolt keeper 18 to pivot to its latch bolt releasing position upon shaft pin 16. Once the door or other access obstructing member has been opened and latch bolt keeper 18 returned to its latch bolt securing position by the urging of turning spring 15, stop lever 20 is again urged to its closed position by torsion spring 26, spring 30 also urges lock lever 22 into its closed position engaging stop lever 20. When the lock lever 22 returns to its closed position, the actuator pin 50 underlying lock lever 22 strikes plunger tip 48 and returns a portion of the plunger tip 48 and the associated plunger 44 to the confines of the solenoid shell 42, with end panel 13*a* serving as a stop for the travel of the plunger 44 through hole 41 of rear cap 40. In the manner heretofore described, plunger 44 moves from a starting position within non-energized solenoid 35 to a stop lever striking position when solenoid 35 is energized, and returns to the starting position when the solenoid is de-energized, all without the urging of any springs within solenoid 35.

Also provided for housing and mounting the electric strike 10 of the present invention within a door jamb is face plate 60 (see FIGS. 13–16). Face plate 60 is constructed of flat stock steel and is of one piece construction. Face plate 60 comprises lip 62 which is convex and overlaps edge 64 of door jamb 66 when face plate 60 is secured to door jamb 66 by screws or other attaching means (not shown) inserted through holes 68 within face plate 60. Face plate 60 further comprises flange tongue 70 which is displaced a distance apart from the outer edge 72 of face plate 60 (see FIG. 14) and the inner edges 74 of face plate 60 (see FIG. 13) thereby forming a channel 76 (see FIG. 15) which serves as a guide for the latch bolt associated with an access obstructing member to engage with the latch bolt keeper 18 and place the latch bolt keeper into its latch bolt securing position.

Figure 13:
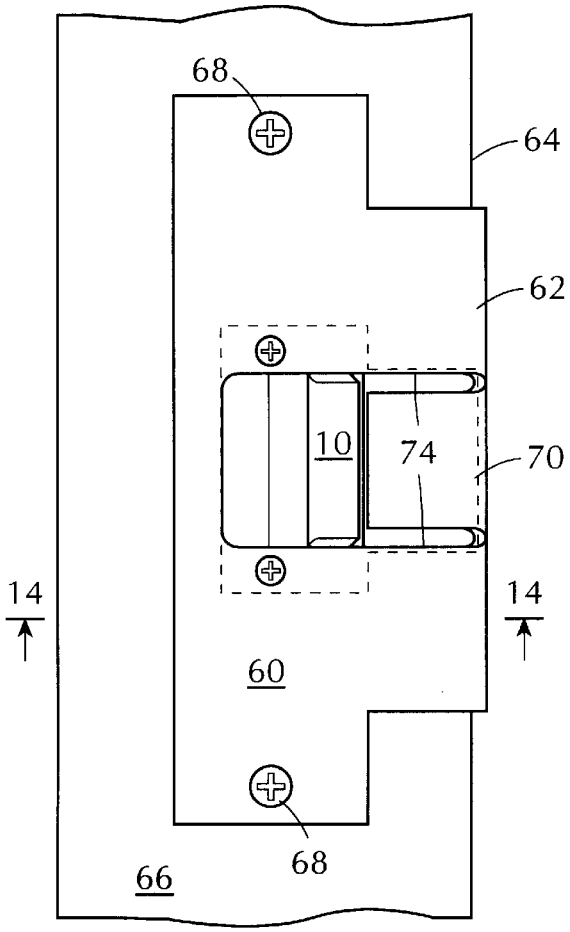
FIG. 13 is a front plan view of the face plate and electric strike of the present invention installed within a door jamb.
Figure 14:
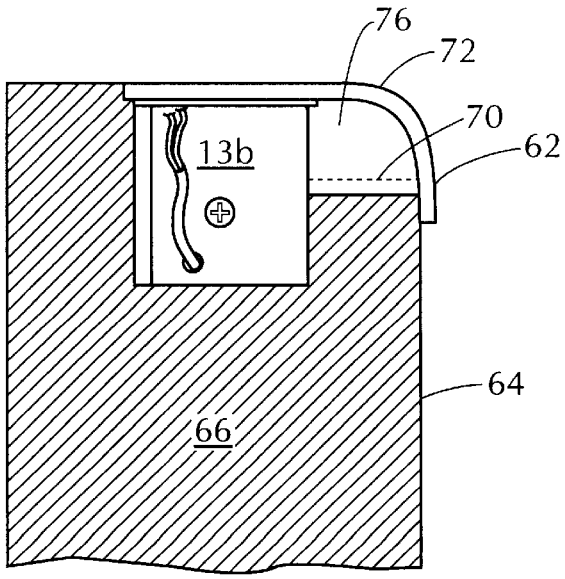
FIG. 14 is a cross-sectional view along line 14—14 of FIG. 13.
Figure 15:
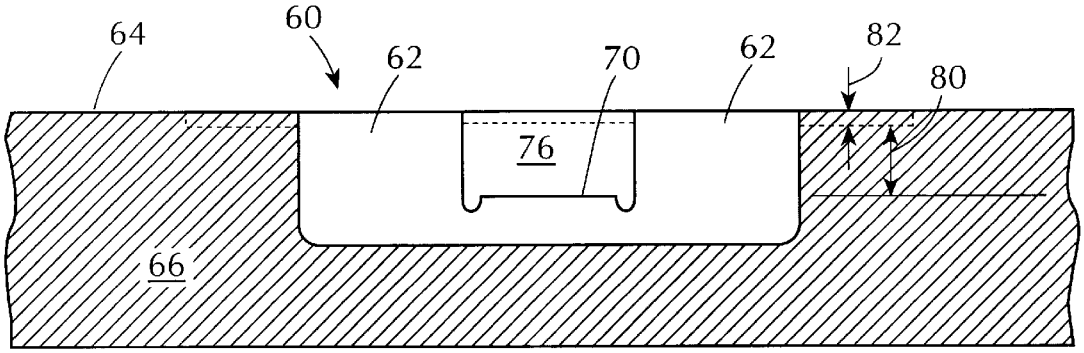
FIG. 15 is a side view of the face plate of the present invention installed within a door jamb.
Figure 16:
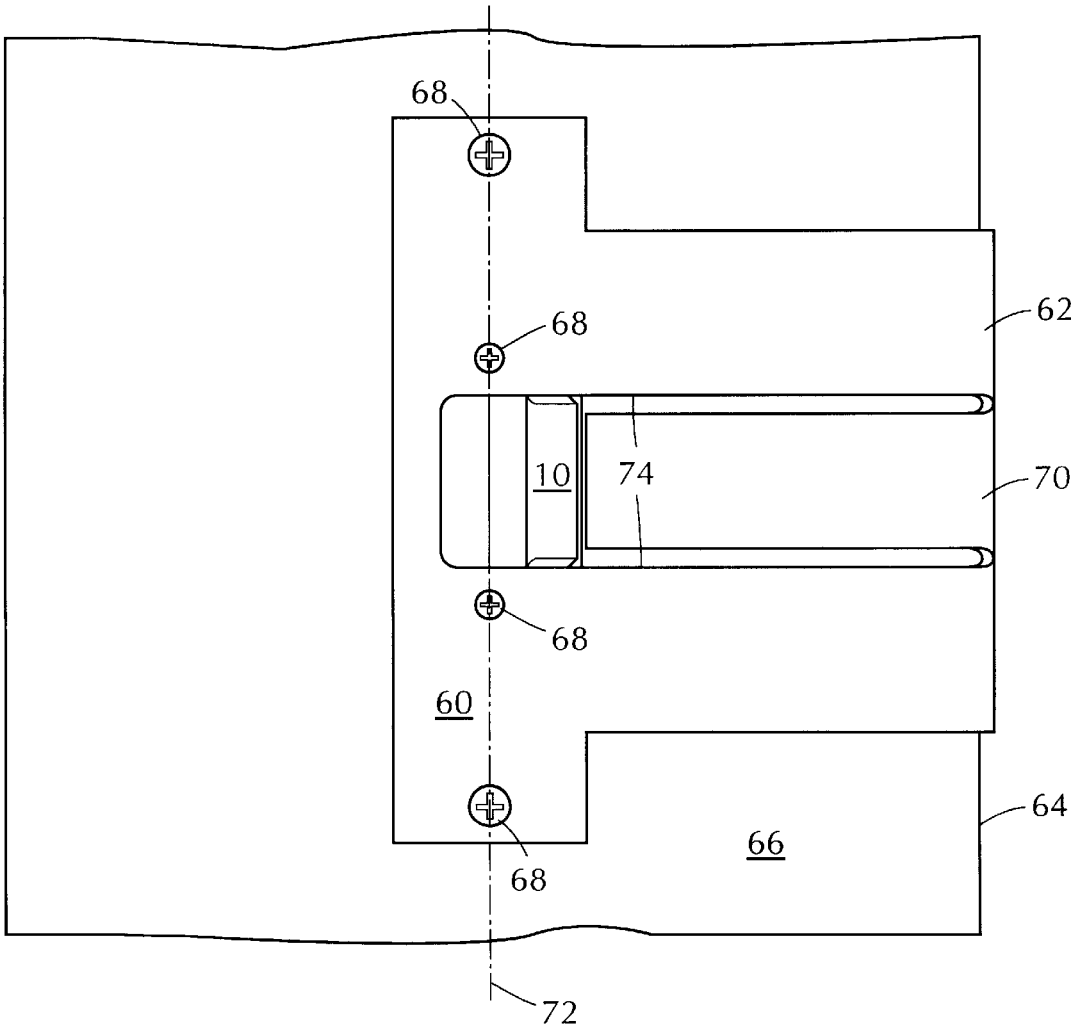
FIG. 16 is a front plan view of a further embodiment of the face plate with the electric strike installed within a door jamb.

The arrangement of the face plate 60 and electric strike 10 within a standard width (1⅜ inches or 1¾ inches) door jamb is depicted in FIGS. 13 and 14. In those instances where the door jamb is wider (such as 4 inches or greater) and the access obstructing member is center hung, thus necessitating the location of the electric strike on or about the centerline 72 of door jamb 66, the embodiment of face plate 60 depicted in FIG. 16 would be utilized. Therein, face plate 60 is of one piece construction and the width of lip 62 and flange tongue 70 are extended from the electric strike 10 to edge 64 of door jamb 66.

Installation of face plate 60 within door jamb 66 requires less cutting and removal of door jamb material (typically metal such as steel or aluminum) than installation of prior art electric strike face plates. Prior art electric strike face plates utilize an auxiliary ramp which requires that a length of door jamb measuring 3⅜ inches at a minimum depth of ½ inch be removed to seat the face plate and ramp into the door jamb. In the present invention much less door jamb material is required to be removed to install the face plate because lip 62 wraps around door jamb 66 (see FIG. 14) thereby requiring only nominal cutting of the edge 64 of door jamb 66 to accommodate the width of narrow notch 76 (about 1⅛ inches) and the depth 80 (about 7/16 inch) of narrow notch 76 below the ⅛ inch cut-out 82 which is precut into standard prefabricated door jambs. Prior art face plates associated with electric strikes typically require a wider (3⅜ inches) notch 76 and/or a greater depth cut 80 (about ½ inch or more) within the door jamb to effect proper installation. A further advantage of face plate 60 is that lip 62 acts as a trim skirt to cover and hide from view that portion of the edge 64 of door jamb 66 which must be cut to accommodate installation of face plate 60. This is of particular advantage in those instances where installation of face plate 60 is performed by a technician in a door jamb which has already been installed in a doorway and hence precise cutting of the door jamb, such as is possible in a factory, is unlikely to occur.

Figure 17:
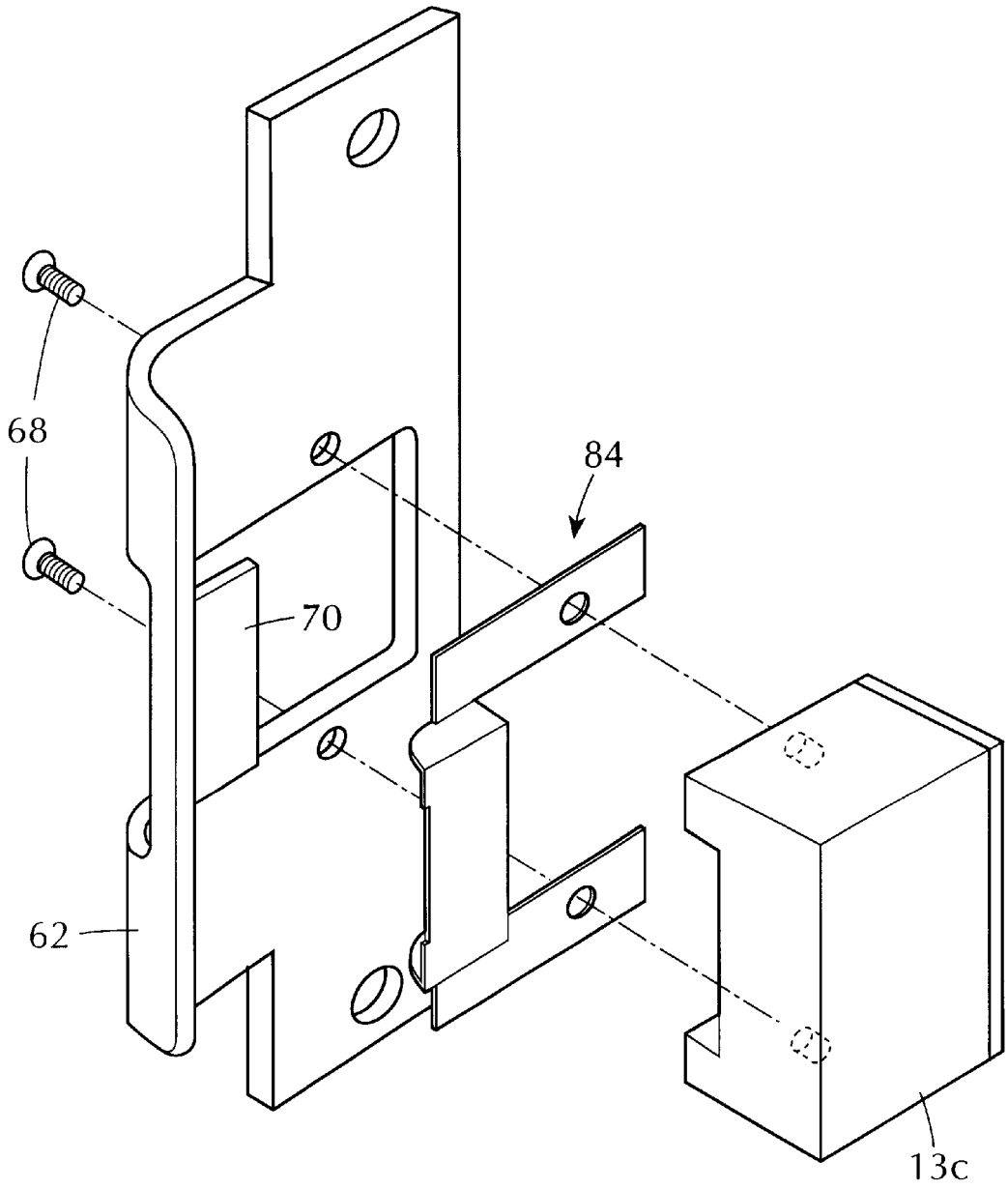
FIG. 17 is an exploded rear perspective view of the face plate of the present invention with a dust shield and electric strike.

Referring to FIG. 17, the face plate may optionally include dust shield 84. The dust shield serves to prevent door jamb filler (typically cement, concrete, wood chips and the like) from entering the face plate channel 76 after installation of the face plate and electric strike into a door jamb and subsequently obstructing the travel of the latch bolt of an adjacent door (not shown) to the latch bolt keeper 18. Dust shield 84 is constructed of aluminum, steel, or other metal and is connected to face plate 60 and the electric strike by screws or other connecting means.

An electronically-operable door strike is provided which readily avoids the problems and shortcomings associated with prior art electric strikes. The preferred embodiment has been illustrated and described. Further modifications and improvements may be made thereto as may occur to those skilled in the art and all such changes as fall within the true spirit and scope of this invention are to be included within the scope of the claims to follow.

What is claimed is:

1. An electronically-operable door strike, comprising:

a base to which is fixedly secured a pair of spaced apart support blocks each having an end panel;

a shaft pin secured to said support blocks;

a latch bolt keeper supported by and rotatable about said shaft pin;

a turning spring mounted circumferentially around said shaft pin, said turning spring disposed to urge said latch bolt keeper into a latch bolt securing position;

a stop lever pivotally secured at one end and having on its opposite free end a means for engaging the free end of a lock lever which is pivotally secured at one end opposite its said free end, said stop lever being urged into its engaging position with said lock lever by a spring and said lock lever being urged into its engaging position with said stop lever by a second spring, said stop lever and said lock lever when engaged preventing said latch bolt keeper from rotating about said shaft pin from the latch bolt securing position to a latch bolt releasing position; and a solenoid, comprising (a) a shell having a ferrous metal front cap with a hole disposed therein and a rear cap of non-ferrous material with a hole disposed therein;

(b) a wire coil wound on a spool within said shell; and (c) a plunger moveable within said spool and disposed within said holes in said front and rear caps to define a first air gap between said plunger and said spool, said plunger comprising a plunger tip of non-ferrous metal and a plunger body of ferrous metal;

where upon said wire coil becoming electrically energized, said front cap acts as a magnet and pulls said plunger toward it causing a portion of said plunger tip to exit said front cap through the hole disposed therein and strike said lock lever, thus pivoting said lock lever until the lock lever is stopped by an end panel, thus defining a second air gap between said plunger body and said front cap, and disengaging said lock lever from said stop lever thereby permitting said latch bolt keeper to be rotated into said latch bolt releasing position.

2. The electronically-operable door strike of claim 1, wherein said spool is a non-ferrous material.

3. The electronically-operable door strike of claim 1, wherein said spool is a synthetic material.

4. The electronically-operable door strike of claim 1, wherein said shell is ferrous metal.

5. The electronically-operable door strike of claim 1, wherein said first air gap extends circumferentially around said plunger between said plunger and said spool.

6. The electronically-operable door strike of claim 1, wherein said rear cap is constructed of non-ferrous metal.

7. The electronically-operable door strike of claim 1, further comprising a guard clip disposed between one of said support blocks and said latch bolt keeper.

8. The electronically-operable door strike of claim 7, wherein a first portion of said guard clip avoids engagement with said lock lever by a tool inserted between said latch bolt keeper and one of said support blocks and wherein a tab and a flange of said guard clip direct said tool away from said lock lever.

9. An electronically-operable door strike assembly for mounting within a door jamb, comprising:

the electronically-operable door strike of claim 1 or claim 7; and a face plate.

10. The electronically-operable door strike of claim 9, further comprising a dust shield.

11. The electronically-operable door strike assembly of claim 9, wherein said face plate comprises:

a convex lip overlapping an edge of said door jamb, a flange tongue displace a distance apart from both an outer edge of said face plate and an inner edge of said face plate to form a channel, wherein said channel acts as a guide for a latch bolt of an access obstructing member to engage with said door strike.

12. The electronically-operable door strike assembly of claim 11, wherein said face plate is flat stock steel of one piece construction.

* * * * *